US006012996A

United States Patent [19]

Lo

[11] Patent Number: 6,012,996

[45] Date of Patent: Jan. 11, 2000

[54] GAME RACKET FRAME MADE OF FIBER REINFORCED PLASTIC

[75] Inventor: Kun-Nan Lo, Taichung Hsien, Taiwan

[73] Assignee: Shenly Won Sport Co., Ltd., Miao Li, Taiwan

[21] Appl. No.: 09/035,084

[22] Filed: Mar. 5, 1998

[51] Int. Cl.[7] ..... A63B 49/10

[52] U.S. Cl. ..... 473/547; 473/535; 473/536

[58] Field of Search ..... 473/535, 536, 473/547

[56] References Cited

U.S. PATENT DOCUMENTS

| | | | |
|---|---|---|---|
| 4,357,013 | 11/1982 | Fernandez et al. | 473/535 |
| 5,217,223 | 6/1993 | Feeney | 473/535 |
| 5,368,298 | 11/1994 | You | 473/536 |
| 5,516,100 | 5/1996 | Natsume | 473/535 |

FOREIGN PATENT DOCUMENTS

| | | | |
|---|---|---|---|
| 2522857 | 12/1976 | Germany | 473/180 FOR |
| 3541590 | 3/1987 | Germany | 473/180 FOR |

*Primary Examiner*—Raleigh W. Chiu
*Attorney, Agent, or Firm*—Browdy and Neimark

[57] ABSTRACT

A game racket frame of fiber reinforced plastic consists of a head formed of an oval main body which is composed of a first inner tube, a second inner tube, and an outer tube. The inner tubes are arranged side by side in the direction toward the head face of the game racket such that the adjoining walls of the inner tubes are attached for forming cross ribs in the main body, and that the outer walls of the inner tubes are intimately attached to the inner wall of the outer tube. The interior of the main body is provided with the cavities of the inner tubes. The main body is further provided with a plurality of string holes extending through the main body in the direction toward the head face of the game racket. The sideway structural strength of the main body is thus reinforced by the cross ribs formed at the junctions of the laminated inner tubes. The intimate association of the laminated outer tube with the walls of the laminated inner tubes eliminates the stress concentration that tends to take place at the junctions of the laminated inner tubes.

6 Claims, 3 Drawing Sheets

GAME RACKET FRAME MADE OF FIBER REINFORCED PLASTIC

FIELD OF THE INVENTION

The present invention relates generally to a game racket frame, and more particularly to a tennis, badminton or squash racket frame formed of a plurality of laminated tubes made of fiber reinforced plastic (F.R.P.) to enable the racket frame to withstand a greater intensity of side stress at the time when the ball-striking face of the head of the racket frame is impacted upon by a ball.

BACKGROUND OF THE INVENTION

The conventional game racket frame is generally formed of one hollow tubular body of fiber reinforced plastic and is therefore limited in its capability to withstand the side stress when the ball-striking face of the head of the conventional game racket is impacted on by a ball, especially at such time when the ball is smashed. As a result, such a conventional game racket frame is vulnerable to severance when the string of the head of the game racket is impacted on by the ball, in view of the fact that the side stress exerting on the game racket frame by the string is greater than the load of the hollow tubular body of which the game racket frame is formed.

An improved version of the game racket frame is disclosed in the U.S. Pat. No. 5,516,100. The game racket frame is formed of a main body consisting of two laminated tubes of fiber reinforced plastic. The main body is provided with a reinforcing rib located between the adjoining walls of the laminated tubes so as to enable the main body to endure a greater intensity of side stress. In fact, the main body which is reinforced by the reinforcing rib is incapable of withstanding the side stress effectively in view of the fact that a stress concentration tends to take place at both sides of the reinforcing rib, and that a strip is embedded in the reinforcing rib. The strip is made of a material different from the material of which the reinforcing rib is made. As a result, the structural integrity of the main body is undermined by the strip. In addition, the structural strength of the racket frame is compromised by the strips which are located at the junctions of the two laminated tubes so as to eliminate the work of providing the racket frame with the string holes. The strips are in fact rather vulnerable to deformation caused by the internal pressure which is brought about by the fluid injected into the laminated tubes at the time when the process of making the racket frame is under way.

SUMMARY OF THE INVENTION

It is therefore the primary objective of the present invention to provide an improved game racket frame capable of withstanding a relatively greater intensity of side stress.

It is another objective of the present invention to provide an improved game racket frame free from the stress concentration formed at the junctions of two adjoining laminated tubes of fiber reinforced plastic.

It is still another objective of the present invention to provide an improved game racket frame with an enhanced physical strength without changing the appearance of the game racket frame.

In keeping with the principle of the present invention, the foregoing objectives of the present invention are attained by a game racket frame consisting of an oval main body for forming a head of the game racket frame. The main body is formed of a first inner tube, a second inner tube, and an outer tube, which are made of prepreg sheets of fiber reinforced plastic. The inner tubes are arranged in a parallel manner in the direction toward the head face of the game racket frame such that the adjoining walls of the inner tubes are attached for forming cross ribs in the main body. The inner tubes are embraced by the outer tube such that the outer walls of the inner tubes are intimately attached to the inner wall of the outer tube, and that the interior of the main body contains only the cavities of the inner tubes. The main body is provided with a plurality of string holes extending in the direction toward the head face of the game racket frame. The sideway structural strength of the game racket frame is thus reinforced by the cross ribs formed at the junctions of the laminated inner tubes. The intimate association of the laminated outer tube with the walls of the laminated inner tubes eliminates the stress concentration that tends to take place at the junctions of the laminated inner tubes.

The foregoing objectives, features, functions, and advantages of the present invention will be more readily understood upon a thoughtful deliberation of the following detailed description of the embodiments of the present invention with reference to the accompanying drawings.

DETAILED DESCRIPTION OF THE INVENTION

Figure 1:
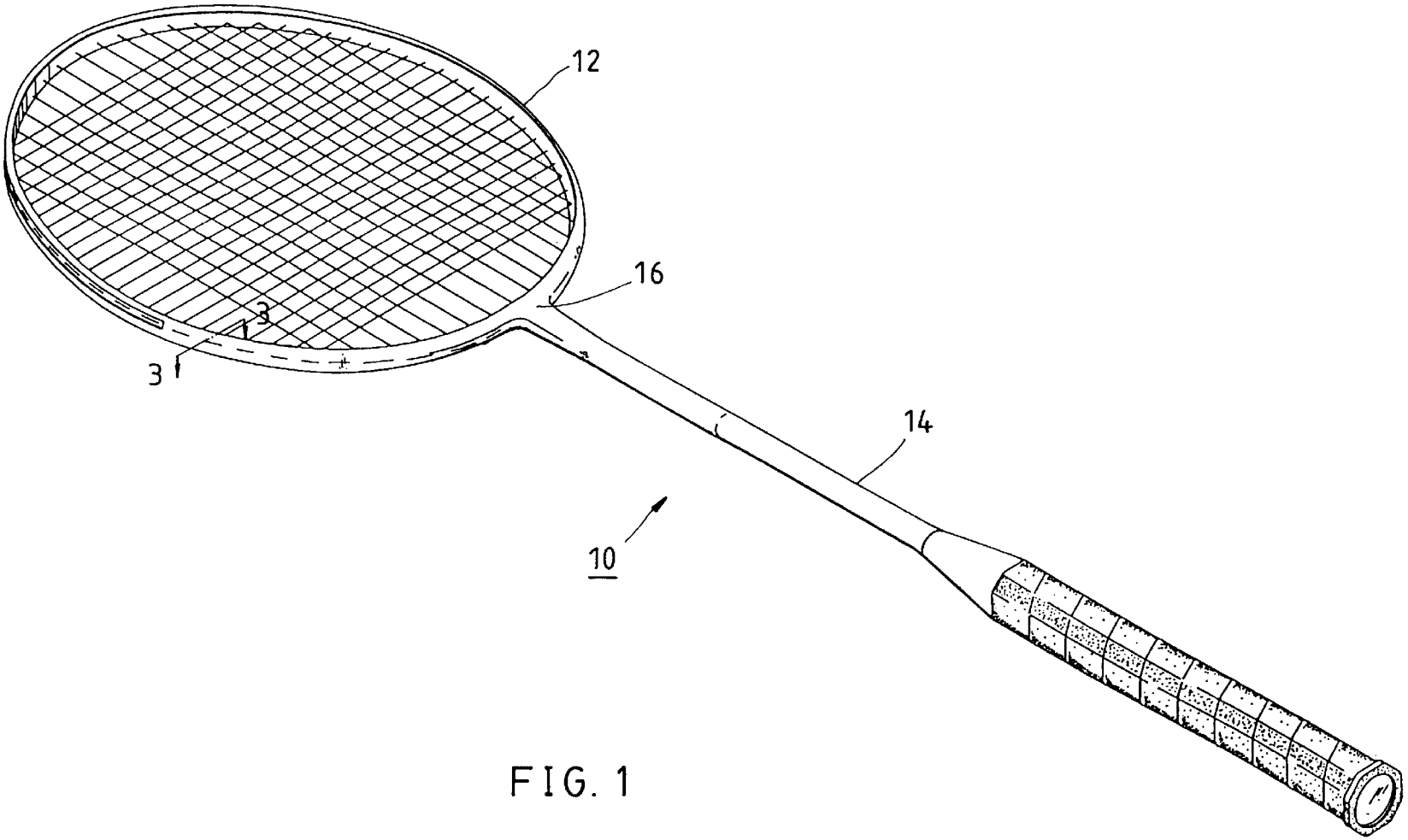
FIG. 1 shows a perspective view of a badminton racket of a preferred embodiment of the present invention.
Figure 2:
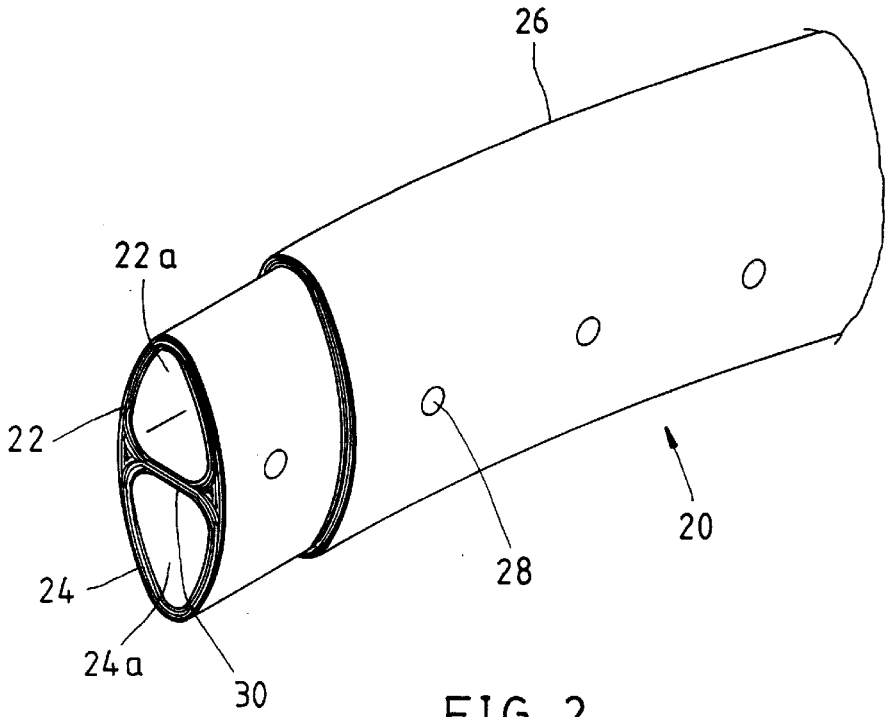
FIG. 2 shows a partial enlarged sectional view of a head of the badminton racket of the preferred embodiment of the present invention.
Figure 3:
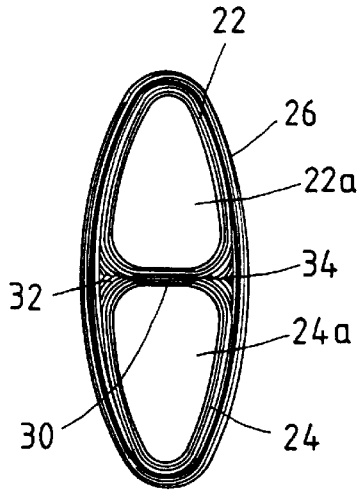
FIG. 3 shows a cross-sectional view of a portion taken along the direction indicated by a line 3—3 as shown in FIG. 1.

As shown in FIGS. 1–3, a badminton racket 10 embodied in the present invention is made of fiber reinforced plastic and composed of a head 12, a handle 14, and a throat 16 located between the head 12 and the handle 14.

The head 12 is formed of an oval main body 20, which consists of a first laminated inner tube 22, a second laminated inner tube 24, and an outer laminated tube 26. The laminated tubes 22, 24 and 26 are formed of a plurality of fiber (such as carbon fiber and glass fiber) prepreg sheets which are impregnated with the thermosetting resin (such as epoxy resin) and are superimposed and wound. The main body 20 is provided with a plurality of string holes 28 extending through the main body 20 in the direction toward the head face of the badminton racket 10.

Figure 4:
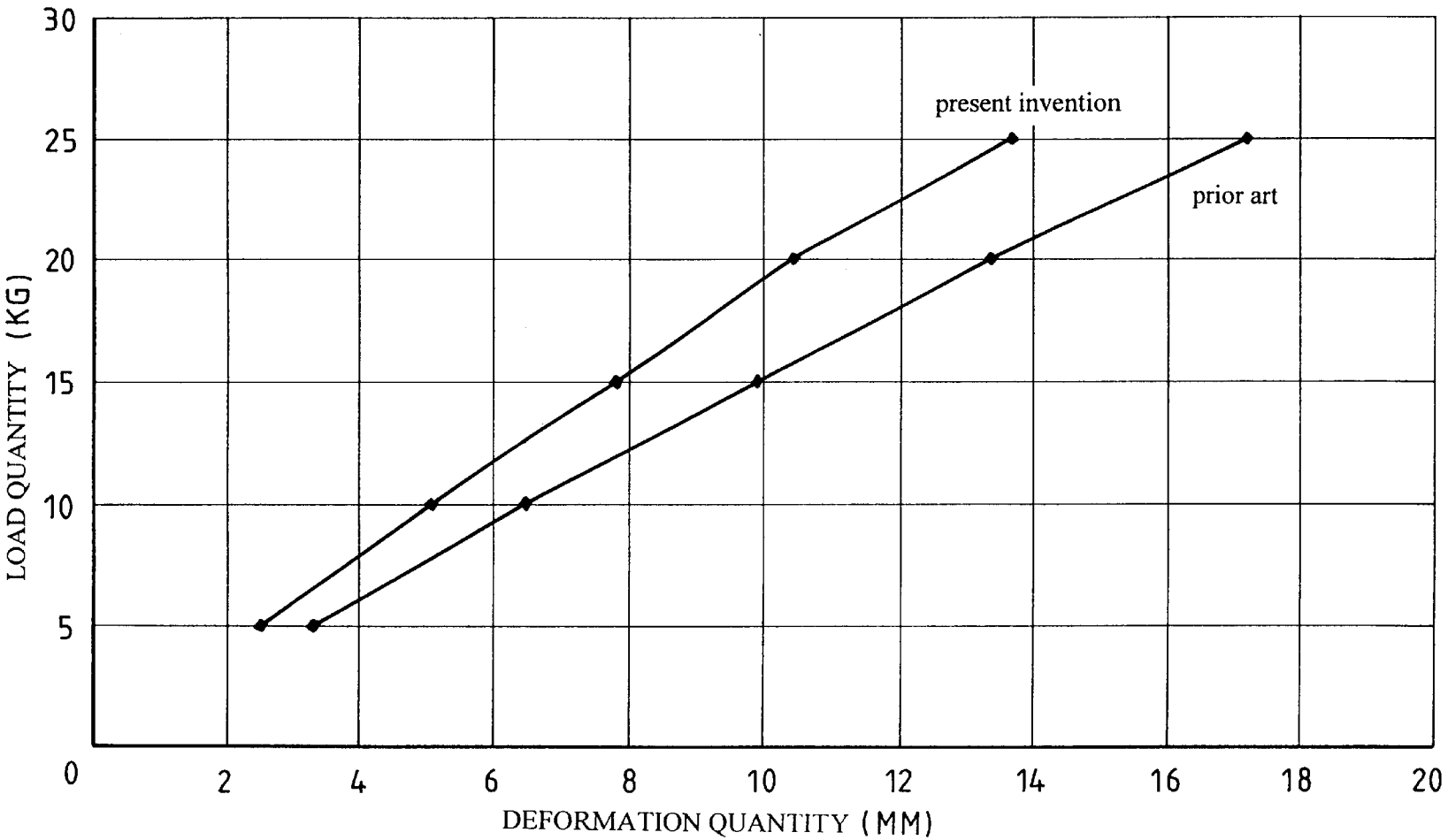
FIG. 4 shows a test diagram comparing the side stress exerting respectively on the heads of the game rackets of the present invention and the prior art.

The first inner tube 22 and the second inner tube 24 are arranged side by side such that a cross rib 30 is formed at a junction of the walls of the first inner tube 22 and the second inner tube 24. The first and the second inner tubes 22 and 24 are completely enclosed by the outer tube 26. Upon formation of the racket, the outer walls of the inner tubes are intimately attached to the inner wall of the outer tube such that the interior of the main body 20 contains cavities 22*a* and 24*a* of the two inner tubes. The outer edge of the attached portion of the wall of each of the inner tubes and the corresponding portion of the inner wall of the outer tube form two thick wall portions 32 and 34, which are located at both ends of the cross rib 30 and are thicker than any other portion. In view of the cross rib 30 and the thick wall portions 32 and 34, the head of the badminton racket 10 of the present invention is capable of withstanding a relatively greater intensity of side stress, as compared with the similar game racket of the prior art. Now referring to FIG. 4, the quantity of deformation of the badminton racket of the present invention is shown to be about 20% less than that of the comparable badminton racket of the prior art when the present invention and the prior art are exerted on by the same side stress.

Figure 5:
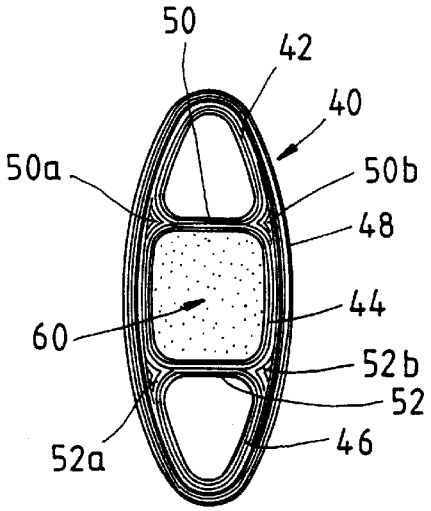
FIG. 5 shows a cross-sectional view of another preferred embodiment of the present invention taken along the direction similar to the line 3—3 as shown in FIG. 1.

As shown in FIG. 5, a game racket frame of another preferred embodiment of the present invention consists of a head, which is formed of a main body 40. The main body 40 is made up of three laminated inner tubes 42, 44, and 46, which are arranged side by side and are embraced by an outer tube 48, as in the first preferred embodiment of the present invention. The main body 40 is therefore provided with two reinforcing ribs 50 and 52, four thick wall portions 50*a,* 50*b,* 52*a,* and 52*b.* The laminated inner tube 44 located at the center of the main body 40 is provided with a cavity in which a shock-absorbing foam body 60 is filled. The main body 40 is therefore capable of absorbing shock and enduring a relatively greater intensity of side stress.

What is claimed is:

1. A game racket made of fiber reinforced plastic and composed of a head, a handle, and a throat located between the head and the handle; wherein said head is formed of an oval main body consisting of a first inner tube, a second inner tube, and an outer tube, said first inner tube, said second inner tube and said outer tube being made of a plurality of prepreg sheets of fiber reinforced plastic such that said prepreg sheets are superimposed and wound, said main body being formed of said inner tubes which are arranged side by side in the direction toward a head face of said head such that adjoining walls of said inner tubes are attached for forming a cross rib partitioning an interior of said main body, and that said inner tubes are completely enclosed by said outer tube in such a way that inner wall of said outer tube is intimately attached to outer walls of said inner tubes, said main body provided in said interior thereof with cavities of said inner tubes, said main body further provided with a plurality of string holes extending through said main body in the direction toward the head face.

2. The game racket as defined in claim 1, wherein said adjoining walls of said inner tubes form a junction having outer edges; and wherein the inner wall of said outer tube has portions respectively corresponding in location to said outer edges, said outer edges and each of said portions being provided with a thick wall portion respectively located at both ends of said cross rib, said thick wall portion being thicker than any other portion of said main body.

3. A game racket made of fiber reinforced plastic and composed of a head, a handle, and a throat located between the head and the handle; wherein said head is formed of an oval main body consisting of three inner tubes, and an outer tube, said three inner tubes and said outer tube being made of a plurality of prepreg sheets of fiber reinforced plastic such that said prepreg sheets are superimposed and wound, said main body being formed of said three inner tubes arranged in series in the direction toward a head face of said head such that adjoining walls of said three inner tubes are attached to form two cross ribs which partition an interior of said main body, and that said three inner tubes are completely enclosed by said outer tube in such a way that inner wall of said outer tube is intimately attached to outer walls of said three inner tubes, said main body provided in said interior thereof with cavities of said three inner tubes, said main body further provided with a plurality of string holes extending through said main body in the direction toward the head face.

4. The game racket as defined in claim 3, wherein a second tube of said three inner tubes is arranged between a first inner tube and a third inner tube such that walls of said second inner tube are respectively attached to a wall of said first inner tube and a wall of said third inner tube to form the two cross ribs which partition said interior of said main body.

5. The game racket as defined in claim 4, wherein said second tube has a cavity for filling therein a foam body capable of absorbing shock.

6. The game racket as defined in claim 3, wherein said adjoining walls of said three inner tubes form junctions having outer edges and wherein the inner wall of said outer tube has portions respectively corresponding in location to said outer edges and each of said portions being provided with a thick wall portion respectively located at each end of said two cross ribs said thick wall portion being thicker than any other portion of said main body.

* * * * *